US005209531A

United States Patent [19]

Thau

[11] Patent Number: 5,209,531

[45] Date of Patent: May 11, 1993

[54] U-SHAPED STRIKER HAVING TAPERING SIDES

[75] Inventor: Wolfgang Thau, Concord, Canada

[73] Assignee: Magna International Inc., Markham, Canada

[21] Appl. No.: 844,747

[22] Filed: Mar. 2, 1992

Related U.S. Application Data

[60] Continuation of Ser. No. 643,102, Jan. 22, 1991, Pat. No. 5,125,698, Division of Ser. No. 20,909, Mar. 2, 1987, abandoned.

[30] Foreign Application Priority Data

Dec. 17, 1986 [CA] Canada ..... 525664

[51] Int. Cl.[5] ..... E05C 3/24

[52] U.S. Cl. ..... 292/216; 292/340; 292/DIG. 39; 292/DIG. 56; 292/341.12

[58] Field of Search ..... 292/216, 280, 340, 341.11, 292/341.12, 341.13, 213, 214, 215, 217, 218, 342, DIG. 23, DIG. 39, DIG. 40, DIG. 56, DIG. 73

[56] References Cited

U.S. PATENT DOCUMENTS

| | | | |
|---|---|---|---|
| 4,165,112 | 8/1979 | Kleefeldt | 292/216 |
| 4,575,138 | 3/1986 | Nakamura et al. | 292/216 |
| 4,941,696 | 7/1990 | Yamada et al. | 292/341.12 |
| 4,981,313 | 1/1991 | Makamura | 292/340 |
| 5,050,917 | 9/1991 | Hamada et al. | 292/DIG. 40 |
| 5,106,134 | 4/1992 | Thau | 292/DIG. 40 |

FOREIGN PATENT DOCUMENTS

| | | | |
|---|---|---|---|
| 1436996 | 5/1972 | United Kingdom | 292/216 |

*Primary Examiner*—Eric K. Nicholson
*Attorney, Agent, or Firm*—Ivor M. Hughes; Neil H. Hughes

[57] ABSTRACT

A striker for a vehicle door locking mechanism, the striker comprising a head providing a base and sloping sides symmetrically tapered in at least two directions towards an apex directed to enter a latch housing; the striker having a shank for mounting the striker, the shank extending away from the striker head.

4 Claims, 9 Drawing Sheets

FIG.4.
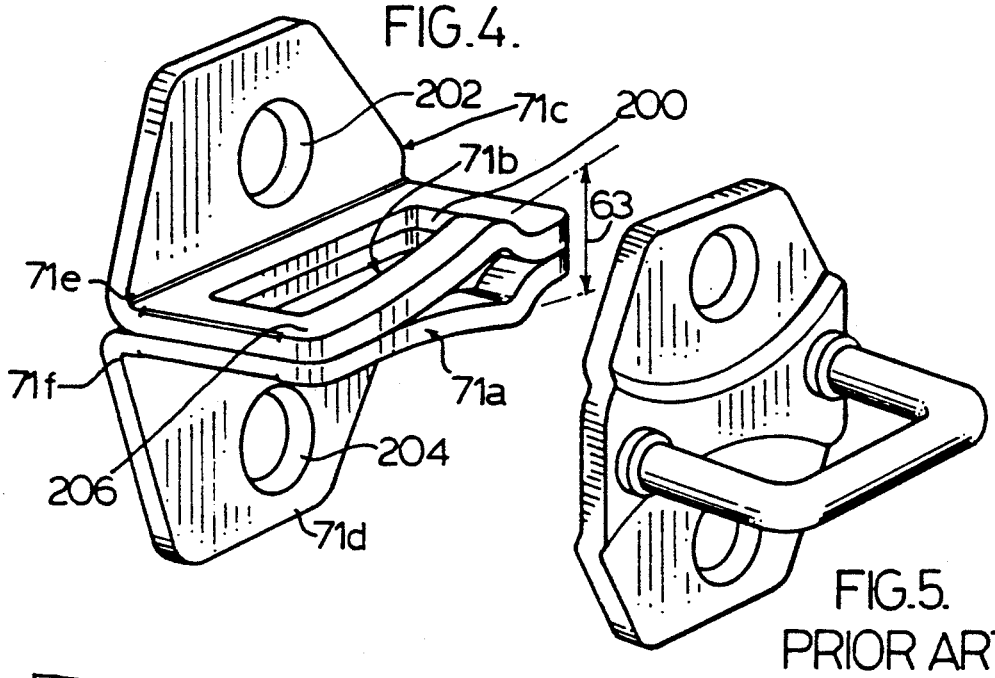
FIG.5.
PRIOR ART.
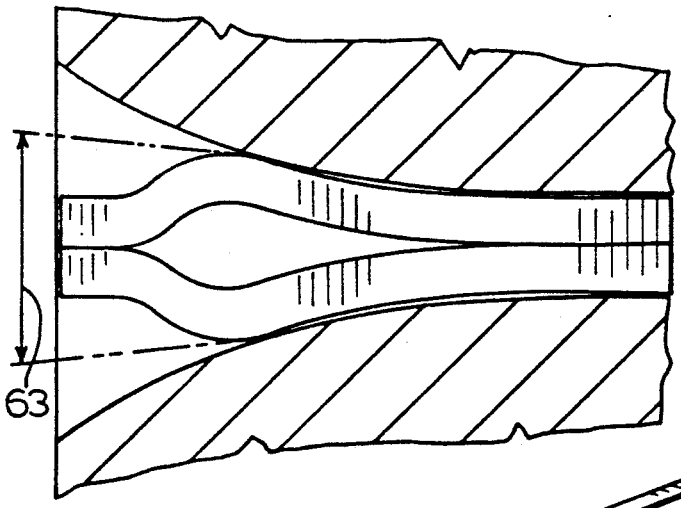
FIG.6.
FIG.7.
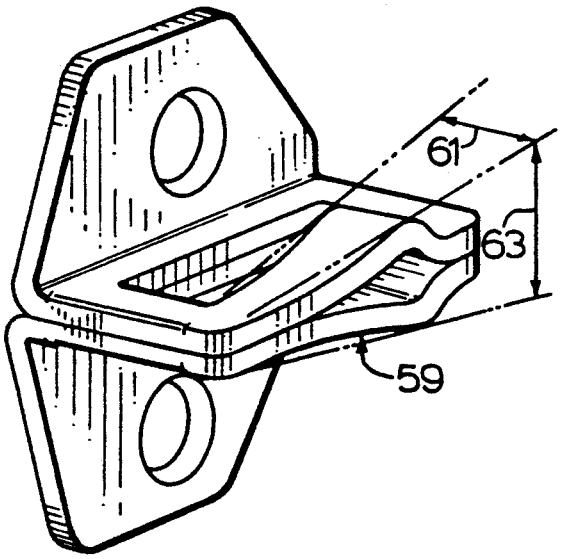

FIG. 8.
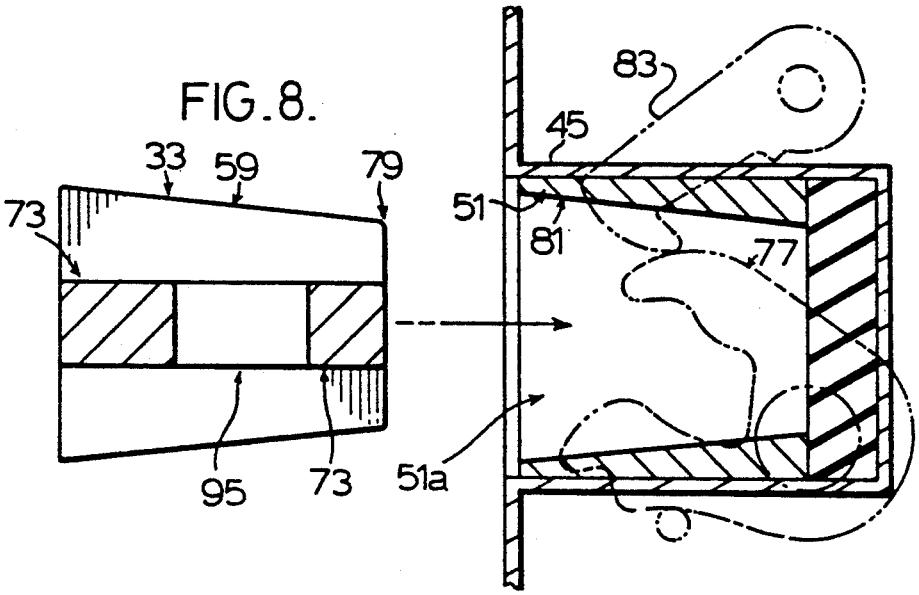
FIG. 9.
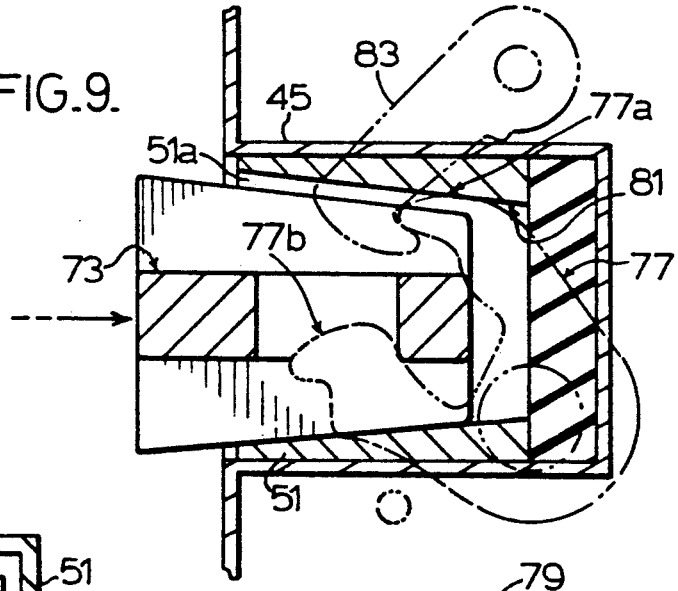
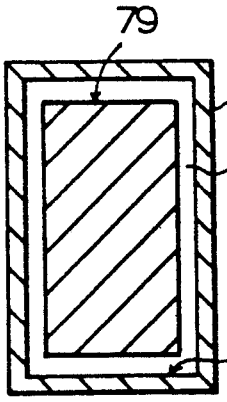
FIG. 10.
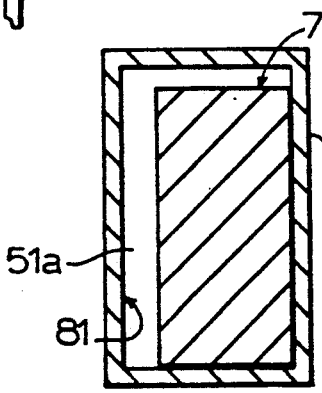
FIG. 11.

FIG.15.
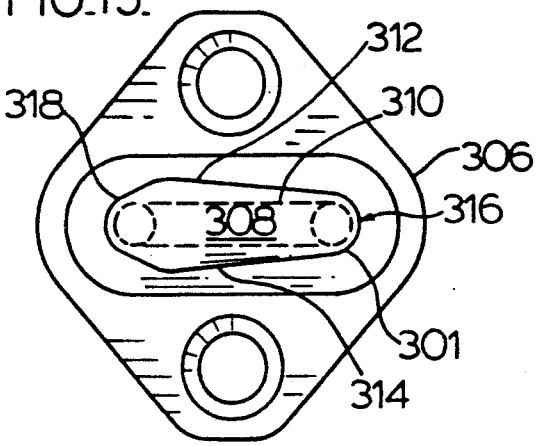
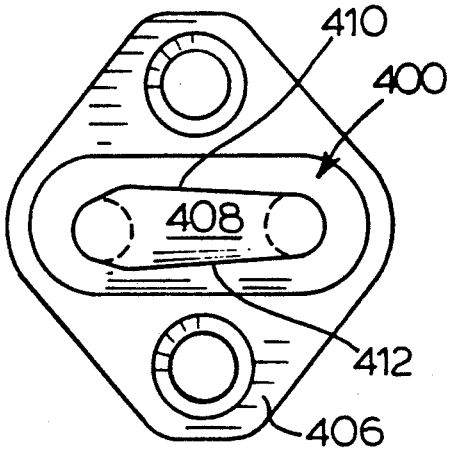
FIG.18.
FIG.16.
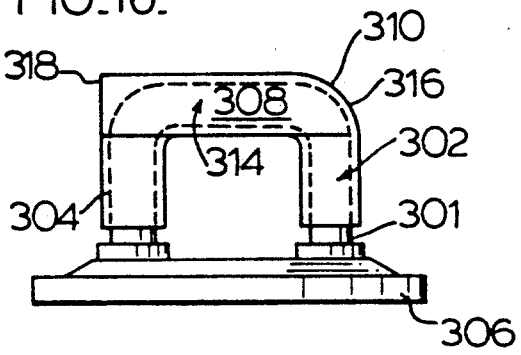
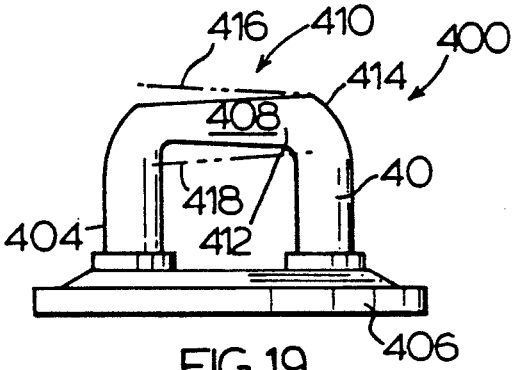
FIG.19.
FIG.17.
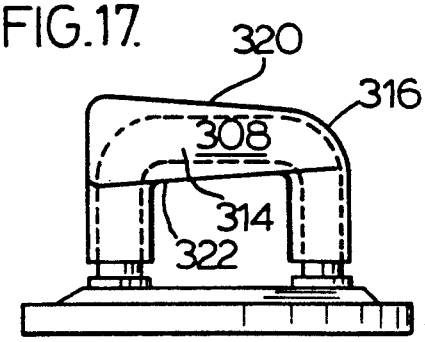

U-SHAPED STRIKER HAVING TAPERING SIDES

This is a continuation of application Ser. No. 07/643,102, filed Jan. 22, 1991, now U.S. Pat. No. 5,125,699 which is a division of application Ser. No. 020909 filed Mar. 2, 1987, now abandoned.

FIELD OF THE INVENTION

This invention relates to an improved vehicle door lock double tapered striker and housing therefor and various single tapered strikers.

BACKGROUND OF INVENTION

It is desirable when designing a lock for a vehicle door to provide a mechanism which will ensure the complete locking engagement of a ratchet with a striker when the door is closed, and which will lessen the possibility of the door becoming unlatched, for example in a collision. It is desirable as well, to design a mechanism which will not be functionally disabled by a collision such that after a collision it is still possible to unlatch the door permitting passengers to leave the vehicle.

It is known that in some instances that during particularly a frontal or side collision the shock of the collision may cause a side door normally in a closed position to buckle and separate from the body of the vehicle in a lateral direction relative to the length of the vehicle. In some instances the extent of such lateral force is sufficient only to urge the engagement surface of a ratchet normally engaging the striker, laterally against the striker. If the ratchet is not secured in a primary engagement position as for example by a detent projecting from a pawl, then such minor lateral forces may be sufficient to pivot the ratchet releasing the striker causing the door to fly open.

In more serious collisions, it is known that force transmitted laterally relative to the length of the car tends to cause the doors to fly open if transferred to the locking engagement of the ratchet with the striker, possibly deforming the ratchet sufficiently to break and thereby release the striker. The resultant unresolved twisting tends to rotate the ratchet in a plane which is not perpendicular to the axis of the striker, thereafter binding such an engagement and preventing normal opening of the door.

In the most common vehicle door latch design wherein the striker comprises a substantially cylindrical shank having a head of extended diameter at the end thereof, the head portion and shank sliding into a horizontally extending slot disposed within the door closed at one end, the ratchet encouraged to rotate by said striker, thereby engaging the shaft behind the head of the striker and thereby preventing the striker from exiting the slot. However, the latch does not rigidly hold the door closed as there is a certain amount of free play resulting in rotating of the door in time. Such rotational forces are usually not in a single plane, and the tendency during a collision is for either the head of the striker to partially or totally shear away from the locking engagement with the ratchet or the ratchet will bend, buckle and twist, thereby disabling the mechanism. Examples of such "pin" type vehicle door locks may be seen in U.S. Pat. Nos. 3,674,296, 4,130,308; 4,357,039; 4,358,141 and 3,367,699.

In an effort to compensate for the rotation of the ratchet relative to the striker in a collision it is known to provide a striker having a structure which is tapered in one axis. Such a "wedge shaped" striker is mounted on a vehicle pillar. The wedge shape is generally horizontal inclined with the smaller cross section of the wedge leading the advance of the striker into a slot for engagement thereat with a ratchet. An example of a wedge shaped striker may be seen in U.S. Pat. Nos. 4,165,112 and 4,219,227 As appears from U.S. Pat. No. 4,219,227 a ratchet engages a depression in the wedge shaped striker. As appears from U.S. Pat. No. 4,165,112 the striker has a hole through it, through which a leg of a U-shaped ratchet passes when the mechanism is engaged. It will be appreciated by those skilled in the art that such an arrangement would tend to prevent rotation of the striker in relation to the housing therefor.

Further it will be appreciated by those skilled in the art that proper engagement of the ratchet with the hole in the striker is very necessary. To this end, such a mechanism requires careful design and installation which ensure in continuous use that when the door is closed, the ratchet will be aligned with the hole in the striker for engagement therewith. Various bumpers, guides and elastomeric devices have been proposed to assist such an alignment. In U.S. Pat. No. 4,219,227 and in an older U.S. Pat. No. 3,858,919 a cone shaped pin is mounted in the slot receiving the door striker. The door striker has a cone shaped recess which slidably fits over the cone shaped pin when the door striker is engaged in the slot for locking. It will be appreciated by those skilled in the art that while the foregoing mechanisms may provide for proper alignment with the aid of bumpers, elastomeric devices and shims during installation. Further such a device may assist in reducing rotation in a plane perpendicular to the axis of the door striker. However the mechanism will still permit longitudinal separation of the striker from the slot in a longitudinal direction in for example the axis of the striker extending away from the pillar generally in the lengthwise direction of the car. Furthermore, because of the design tolerances required it is likely that any deformation of the locking mechanism components concomitant with a collision will cause jamming, resulting in difficulty for a passenger to release the locking mechanism in order to leave the car.

It is known in the art to provide an engagement between a striker and a slot for receiving the striker which will resist the longitudinal separation of the striker from the slot for receiving same. For example, U.S. Pat. Nos. 1,192,733 and 2,100,591 disclose a "hook shaped" striker. The hook or projection of the striker fits into a slot which is generally Ushaped and surrounds the hook, thereby preventing longitudinal separation. In the U.S. Pat. No. 2,100,591, a bolt slides internally of the U-shaped slot for engaging a corresponding aperture in the hook. In this manner, the hook cannot slide out of the recess.

In U.S. Pat. No. 2,758,864 a locking mechanism is disclosed wherein the striker is generally T-shaped in cross section and may be slidingly keyed into a slot having the same T-shaped cross section. The leading edge of the striker having a T-shaped cross section is formed with a cam surface for displacing a spring biased latch bolt which may slidably enter the slot. When the door is closed the cam surface of the striker raises the latch bolt. The latch bolt passes over the striker to the back) of the striker and blocks its exit from the slot. It will be appreciated by those skilled in the art that such an arrangement is similar in principle to the traditional arrangement of a striker pin engaging a pivotable ratchet which once engaged blocks the exit of the striker pin from the slot.

In United Kingdom Patent 239,691 there is provided a latching mechanism for use in a motor vehicle wherein the "striker" slidingly engages a slot in a latch housing. The striker is of a generally T shaped cross-section the head of the striker is tapered in two directions, being wider at the base than the leading edge and has a transverse taper from the base at the back, to the front. The neck of the striker is also tapered, being wider proximate the base than the leading edge. The slot is tapered in two directions comprising a "V" shaped taper matching that of the neck of the striker and a transverse taper matching the transverse taper of the head of the striker. The combination, of the transverse taper of the striker head and the transverse taper of the slot draws the striker and the latch housing together when placed in engagement. It will be appreciated by those skilled in the art that the transverse taper is not symmetrical. Exact alignment of the striker with the slot is therefore required during design and installation thereof.

In U.S. Pat. No. 4,466,645 a U-shaped striker is disclosed having a part covered by a mould-formed plastics material, the portion of which carried at the juncture of one corner of the horizontal connector and leg which is pushed into a door latch being thicker, to present a columnar shape.

It is therefore an object of this invention to provide a resiliently biased vehicle door locking mechanism which will provide for the broader tolerance engagement of a striker in a latch housing therefor.

It is a further object of this invention to provide a vehicle door locking mechanism which will ensure the complete engagement of a ratchet with a striker when the door is normally closed, thereby avoiding the unintentional opening of a door.

It is a further object of this invention to provide a vehicle locking mechanism which will evenly distribute the load in a collision, thereby avoiding the forced opening of a door in a collision, by resolving any forces upon the mounting members of the ratchet mechanism and not upon the ratchet mechanism itself.

It is a further object of this invention to provide a vehicle locking mechanism better adapted to withstand collision, whereby the ability of passengers to unlatch the door after a collision will be facilitated.

It is a further object of this invention to provide improved strikers of simple construction yet effective for use in a locking mechanism.

Further and other objects of this invention will be apparent to those skilled in the art from the following summary of the invention and detailed description thereof.

SUMMARY OF INVENTION

According to one aspect of the invention there is provided a striker for a vehicle door locking mechanism, the striker comprising a three dimensional head having two ends, length, width and height, and two pairs of opposing faces, each face having opposed sloping sides, each face of one pair of opposing faces being oriented in the length and height of the three dimensional head and presenting the two opposed sides tapering towards one another along a substantial length of the head from a first broad portion positioned at least proximate one end to an apex positioned proximate the other end for entering a latch housing and the other pair of opposing faces being oriented in the length and width of the three dimensional head and presenting two opposed sides tapering towards one another along a substantial length of the head from a second broad portion positioned at least proximate one end to an apex positioned proximate the other end the first and second broad portions being proximate one another; of the striker between the ends (for example, each sloping side is symmetrically tapered in at least two directions towards the apex) the striker having a shank for mounting the striker, the shank extending away from the striker head, the striker also comprising an aperture through the shank for receiving a ratchet extending through the striker.

According to another aspect of the invention there is provided a striker for a vehicle door locking mechanism, the striker comprising a three dimensional head having two ends length, width and height, and two pairs of opposing faces, each face having opposed sloping sides, each face of one pair of opposing faces being oriented in the length and height of the three dimensional head and presenting the two opposed sides symmetrically tapered towards one another along a substantial length of the head from a first broad portion at one end to an apex at the other end for entering a latch housing and the other pair of opposing faces being oriented in the length and width of the three dimensional head and presenting two opposed sides symmetrically tapering towards one another along a substantial length of the head from a second broad portion of one end to an apex at the other end for entering a latch housing the first and second broad portions being proximate one another; the striker having a shank for mounting the striker, the shank extending laterally away from one side of the striker head for sliding engagement with a slot extending longitudinally along one side of a latch housing, the striker also comprising a latch-receiving aperture extending through the striker.

According to a preferred embodiment of the invention the striker head is of a generally frustrum trapezoidal configuration.

According to another aspect of the invention there is provided a latch housing for a vehicle door locking mechanism, the latch housing comprising a body having at least one side open of a configuration for receiving a movable female portion of compatible configuration; the movable female portion having an external configuration suitable for fitting telescopically inside the opening in the latch housing and being reversibly slideable therein, the movable female portion having an inside surface of a configuration matching the configuration of a striker head and suitable for surrounding the striker head at least about 360°, the movable female portion suitable for receiving a striker head in a tolerance fit, the latch housing having a means for limiting the slideable retraction of the movable female portion into the latch housing and limiting the extension of the movable female portion out of the latch housing; whereby the movable female portion suitable for receiving the striker head in a tolerance fit is only slideable for linear movement in the latch housing when a striker head is completely seated in the female portion.

According to a preferred embodiment of the invention the latch housing comprises a body having at least one side open of a configuration for receiving a movable female portion of compatible configuration and one side perpendicular to the said opening having a slot extending longitudinally suitable for slideably receiving the shank of a striker; the movable female portion having an external configuration suitable for fitting telescopically inside the opening in the latch housing and being reversably slideable therein, the movable female portion having an inside surface of a configuration matching the configuration of a striker head and suitable for surrounding the striker head at least about 360°, the movable female portion having a slot extending longitudinally on one side parallel and adjacent to the slot on one side of the latch housing for slideably receiving the shank of the striker, the movable female portion suitable for receiving the striker head in a tolerance fit, the latch housing having a means for limiting the slideable retraction of the movable female portion into the latch housing and limiting the extension of the movable female portion out of the latch housing; whereby the movable female portion suitable for receiving the striker head in a tolerance fit is only slideable for linear movement in the latch housing when a striker head is completely seated in a female portion.

According to another aspect of the invention there is provided a vehicle door locking mechanism for releasably locking a vehicle door in a closed position, the mechanism comprising:

a) a striker securely mounted on either of a pillar or a door, suitable for slideably engaging a latch housing; the striker having a head providing a base and sloping sides symmetrically tapered in at least two directions, towards an apex directed to enter a latch housing; the striker having a shank for mounting the striker, the shank extending away from the striker head, preferably laterally away from one side of the striker head for sliding engagement with a slot extending longitudinally along one side of a latch housing;

b) a latch housing securely mounted on either of a pillar or a door, suitable for slideably receiving the striker of (a); the latch housing comprising a body having at least one side open of a configuration for receiving a movable female portion of compatible configuration; the movable female portion having an external configuration suitable for fitting telescopically inside the opening in the latch housing and being reversably slideable therein, the movable female portion having an inside surface of a configuration matching the configuration of the striker head and suitable for surrounding the striker head at least about 360°, the movable female portion suitable for receiving the striker head in a tolerance fit, the latch housing having a means for limiting the slideable retraction of the movable female portion into the latch housing and limiting the extension of the movable female portion out of the latch housing;

c) ratchet means for engaging the striker suitable for locking the striker inside the latch housing and suitable for releasing the striker for permitting the slideable movement of the striker out of the latch housing.

Preferably the door locking mechanism for releasably locking a vehicle door in a closed position comprises:

a) a striker securely mounted on either of a pillar or a door, suitable for slideably engaging a latch housing; the striker having a head providing a base and sloping sides symmetrically tapered in at least two directions, towards an apex directed to enter a latch housing; the striker having a shank for mounting the striker, the shank extending away from the striker head, preferably laterally away from one side of the striker head for sliding engagement with a slot extending longitudinally along one side of a latch housing;

b) a latch housing securely mounted on either of a pillar or a door, suitable for slideably receiving the striker of (a); the latch housing comprising a body having at least one side open of a configuration for receiving a movable female portion of compatible configuration and one side perpendicular to the said opening having a slot extending longitudinally suitable for slideably receiving the shank of the striker; the movable female portion having an external configuration suitable for fitting telescopically inside the opening in the latch housing and being reversably slideable therein, the movable female portion having an inside surface of a configuration matching the configuration of the striker head and suitable for surrounding the striker head at least about 360°, the movable female portion having a slot extending longitudinally one side parallel and adjacent to the slot on one side parallel and adjacent to the slot on one side of the latch housing for slideably receiving the shank of the striker, the movable female portion suitable for receiving the striker head in a tolerance fit, the latch housing having a means for limiting the slideable retraction of the movable female portion into the latch housing and limiting the extension of the movable female portion out of the latch housing;

c) ratchet means for engaging the striker suitable for locking the striker inside the latch housing and suitable for releasing the striker for permitting the slideable movement of the striker out of the latch housing.

Preferably the latch housing comprises a body having an opening for access to a generally rectangular internal configuration for receiving a movable female portion of compatible configuration comprising a generally rectangular external configuration suitable for fitting telescopically inside the opening in the latch housing and being reversably slideable therein.

Preferably the movable female portion has an inside configuration of a generally frustum trapezoidal configuration matching the frustum trapezoidal shape of the striker head in a preferred embodiment.

Preferably the ratchet means for engaging the striker is suitable for locking the striker inside the latch housing only when the striker head is completely seated in the movable female portion whereby the movable female portion of the latch housing when struck by the striker only slides into the latch housing when the striker head is completely seated therein, thereby providing tolerance for the engagement of the striker head inside the movable female portion and alignment of the ratchet means with the striker.

Preferably where the shank of the striker extends laterally away from one side of the striker head for sliding engagement with a slot extending longitudinally along one side of a latch housing, the shank of the striker comprises a hole directed therethrough suitable for receiving at least one leg of a ratchet, for releasably locking the striker inside a latch housing.

According to a preferred embodiment of the invention the means for limiting the slideable retraction of the movable female portion into the latch housing comprises resilient biasing means suitable for absorbing the kinetic force of the striker when moving the female portion in a linear direction upon closure of the door and suitable for causing the movable female portion to thereafter recoil.

According to a preferred embodiment of the invention there is provided a vehicle door locking mechanism for releasably locking a vehicle door in a closed position, the mechanism comprising:

a) a striker securely mounted on either of a pillar or a door, suitable for slideably engaging a latch housing; the striker having a head symmetrically tapered in at least two directions, of a generally frustum trapezoidal configuration having an apex directed towards a latch housing; the striker head having a shank for mounting the striker, the shank extending laterally away from one side of the striker head for sliding engagement with a slot extending longitudinally along one side of a latch housing;

b) a latch housing securely mounted on either of a pillar or a door, suitable for slideably receiving the striker of (a); the latch housing comprising a body of a generally rectangular internal configuration having at least one side open for receiving a movable female portion and one side perpendicular to the said opening having a slot extending longitudinally suitable for slideably receiving the shank of the striker; the movable female portion having a generally rectangular external configuration suitable for fitting telescopically inside the opening in the latch housing and being reversably slideable therein, the movable female portion having an inside surface of a generally frustum trapezoidal configuration matching the configuration of the striker head suitable for surrounding the striker head at least about 360° and having a slot extending longitudinally on one side parallel and adjacent to the slot on one side of the latch housing for slideably receiving the shank of the striker, the movable female portion suitable for receiving the striker head in a tolerance fit and being slideable for linear movement in the latch housing only when the striker head is completely seated in the female portion, the latch housing having a means for limiting the slideable retraction of the movable female portion into the latch housing and limiting the extension of the movable female portion out of the latch housing;

c) ratchet means for engaging the striker suitable for locking the striker inside the latch housing only when the striker head is completely seated in the movable female portion and suitable for releasing the striker for permitting the slideable movement of the striker out of the latch housing;

d) whereby the movable female portion of the latch housing when struck by the striker only slides into the latch housing when the striker head is completely seated therein thereby providing tolerance for the engagement of the striker head inside the movable female portion and alignment of the ratchet means with the striker.

According to another aspect of the invention, a striker is provided comprising two rectangular portions each having two opposed end edges and two sides carrying a mounting aperture and a latch-receiving aperture therethrough for receiving a latch, the two rectangular portions each being bent intermediate their end edges and disposed normal (substantially 90 degrees) to one another, the portion between the edge of the latch-receiving aperture remote the bend and closed end edge to the latch-receiving aperture of each rectangular portion is curved laterally in a direction away from the plane of the bent portion containing the latch-receiving aperture in a direction towards the portion containing the mounting aperture whereby when the two portions containing the latch-receiving aperture are aligned and joined together, the end of the striker provides two symmetrical laterally-extending curved portions tapered towards an apex directed for centering a latch housing and preferably each portion between the latch-receiving aperture remote the bend and closest end edge to the latch-receiving aperture remote the bend tapers in another direction towards the apex extending along a substantial portion of the portion between the edge of the latch-receiving aperture remote the bend and edge of the latch-receiving aperture between the two sides of the striker.

According to another aspect of the invention the part of the portion of each curved portion between the edge of the latch-receiving aperture remote from the bend and the closest end edge of the portion to the latch-receiving aperture tapers from a second broad portion to a narrower portion, each second broad portion being proximate at least one of the two broad curved portions.

According to another aspect of the invention, the striker may be covered by a compressible moulded plastics material. In some embodiments the end of the striker provides two additional portions extending in another direction tapered towards the apex. In some embodiments the apex of the striker is intermediate the sides of the bent rectangular portions thus providing a flat unbent portion between the apex and one of the sides.

According to another aspect of the invention, a striker is provided comprising two portions each having two opposed end edges and two sides and carrying at least one mounting aperture and a latch-receiving aperture having two spaced edges extending towards the two sides between the two opposed end edges, the two portions each being bent intermediate its end edges to provide two portions a first portion and a second portion disposed substantially normal to one another, one of the first and second portions carrying the latch-receiving aperture and the other portion carrying the at least one mounting aperture, the part of the portion between the edge of the latch-receiving aperture remote from the bend and the closest end edge of the portion to the latch-receiving aperture being curved laterally in a direction away from the plane of the portion carrying the latch-receiving aperture in a direction parallel to the portion containing the mounting aperture wherein the two portions containing the latch-receiving apertures are aligned and joined proximate one another to provide two curved portions between the sides, the curved portions (a) being symmetrical with respect to one another having regard to a first axis extending between the two curved portions and being coplanar with the plane of the first or second portion carrying the latch-receiving apertures and (b) forming two portions on either side of a second axis extending substantially at 90° to the first axis and the plane of the portion carrying the latch-receiving aperture, the second axis being centrally located between the sides of the striker, the two portions being spaced from the second axis to provide two broad curved spaced portions on either side of the first axis and on the same side of the second axis, their broadest extent being spaced from the first axis and two narrower curved portions on either side of the first axis and on the same side of the second axis which converge at an apex spaced from the second axis whereby each curved portion tapers from a broad portion proximate one side of the portion to an apex proximate the other side for centering in a latch housing, the curved tapered portions extending along a substantial portion of the portion between the edge of the latch-receiving aperture remote from the bend and the closest end edge of the latch-receiving aperture between the two sides of the striker.

According to another aspect of the invention, the striker may comprise a U shaped rod comprising a pair of legs anchored to a base and a connector rod connecting the legs, the connector and portions of the upper ends of the legs connected to the connector being covered by a compressible moulded plastics material, the covered portion presenting a three dimensional head having two ends, length, width and height, and two pairs of opposing faces, each face having opposed sloping sides, each face of one pair of opposing faces being oriented in the length and height of the three dimensional head and presenting the two opposed sides tapering towards one another along a substantial length of the head from a first broad portion positioned at least proximate one end to an apex positioned proximate the other end for entering a latch housing and the other pair of opposing faces being oriented in the length and width of the three dimensional head and presenting two opposed sides tapering towards one another along a substantial length of the head from a second broad portion positioned at least proximate one end to an apex positioned proximate the other end the first and second broad portions being proximate one another; the striker having a shank for mounting the striker, the shank extending away from the striker head, the striker also comprising an aperture through the shank for receiving a ratchet extending through the striker. (in one embodiment the two sides each taper in two directions towards the apex).

According to another aspect of the invention, the striker may comprise a pair of legs anchored to a base and a flattened connector wire connecting the legs, the flattened connector wire to present at least two sides symmetrically tapered in at least one direction towards an apex directed to entering a latch housing. Preferably, the flattened connector is symmetrically tapered in at least two directions towards an apex directed to entering a latch housing.

According to another aspect of the invention, a striker is provided having two sides and two ends, the striker to present two sides symmetrically tapered in at least two directions towards an apex directed for entering a latch housing along a substantial length of the striker between the two ends and carrying a latch-receiving aperture extending through the striker. In one embodiment, the two sides each taper in at least two directions towards the apex directed for entering the latch housing.

According to another aspect of the invention, a striker is provided having two ends presenting a compressible plastics portion comprising a three dimensional head having two ends, length, width and height, and two pairs of opposing faces each face having opposed sloping sides, each face of one pair of opposing faces being oriented in the length and height of the three dimensional head and presenting the two opposed sides tapering towards one another along a substantial length of the head from a first broad portion positioned at least proximate one end to an apex positioned proximate the other end for entering a latch housing and the other pair of opposing faces being oriented in the length and width of the three dimensional head and presenting two opposed sides tapering towards one another along a substantial length of the head from a second broad portion positioned at least proximate one end to an apex positioned proximate the other end the first and second broad portions being proximate one another; the striker having a shank for mounting the striker, the shank extending away from the striker head, the striker also comprising an aperture through the shank for receiving a ratchet extending through the striker and the striker also carrying a latch-receiving aperture extending through the striker, along a substantial length of the striker between the two ends and carrying a latch-receiving aperture extending through the striker in other than the compressible tapered plastics portion.

In some embodiments of the described striker the apex is intermediate the two ends and the portion between the apex and the end on the side of the apex remote the sloping sides is flat and unbent.

In one embodiment, the two sides each taper in at least two directions towards the apex directed for entering the latch housing.

According to another aspect of the invention, a striker is provided having two sides and two ends, the striker to present two sides symmetrically tapered in at least two directions towards an apex directed for entering a latch housing along a substantial length of the striker between the two ends and carrying a latch-receiving aperture extending through the striker. In one embodiment, the two sides each taper in at least two directions towards the apex directed for extending the latch housing, wherein the faces of plastics portion are symmetrically tapered.

According to another aspect of the invention, the apex is intermediate the sides of the bent portion thus providing a flat unbent portion between the apex and one of the sides.

According to another aspect of the invention, a striker is provided comprising two portions each having two opposed end edges and two sides and carrying mounting means and a latch-receiving aperture having two spaced edges extending towards the sides between the two opposed end edges, the two portions each comprising a first and second portion disposed normal to one another, one of the first and second portions carrying the latch-receiving aperture, the part of the portion between the edge of the latch-receiving aperture remote from the first or second portion not carrying the latch-receiving aperture and the closest end edge of the portion to the latch-receiving aperture being curved laterally in a direction away from the plane of the portion carrying the latch-receiving aperture in a direction parallel to the portion not carrying the latch-receiving aperture wherein the two portions containing the latch-receiving apertures are aligned and joined proximate one another to provide two curved portions between the sides the curved portions (a) being symmetrical with respect to one another having regard to a first axis extending between the two curved portions and being coplanar with the plane of the first or second portion carrying the latch-receiving aperture and (b) forming two portions on either side of a second axis extending substantially at 90° to the first axis and the plane of the portion carrying the latch-receiving aperture, the second axis being centrally located between the sides of the striker, the two portions being spaced from the second axis to provide two broad curved shaped portions one either side of the first axis and on the same side of the second axis, their broadest extent being spaced from the first axis thereby being spaced from the center of the portions and two narrower curved portions on either side of the first axis and on the same side of the second axis which converge at an apex spaced from the second axis whereby each curved portion tapers from a broad portion proximate one side of the portion to an apex proximate the other side for centering in a latch housing, the curved tapered portions extending along a substantial portion of the portion between the edge of the latch-receiving aperture remote from the first or second portion not carrying the latch-receiving aperture and the closest end edge of the latch-receiving aperture between the two sides of the striker.

According to another aspect of the invention, the part of the portion of each curved portion between the edge of the latch-receiving aperture remote from the portion not carrying the latch-receiving aperture and the closest end edge of the portion to the latch-receiving aperture tapers from a second broad portion to a narrower portion, each second broad portion being proximate at least one of the two broad curved portions.

According to another aspect of the invention, the apex is intermediate the sides of the portion carrying the latch-receiving aperture thus providing a flat unbent portion between the apex and one of the sides.

The invention will now be illustrated with reference to the following drawings of an embodiment of the invention and detailed description thereof.

BRIEF DESCRIPTION OF THE DRAWINGS

FIG. 4 is a perspective view of a striker tapered in one direction.

FIG. 4A shown together with FIG. 7A are perspective views of the strikers of FIGS. 4 and 7, respectively, covered in compressible moulded plastics material.

FIG. 5 is a perspective view of a striker as known in the prior art.

FIG. 6 is a top view of the striker in FIG. 4.

FIG. 7 is a perspective view of another striker tapered in two directions, in one embodiment.

FIG. 8 is a schematic side view of the striker and latch housing in FIG. 3 comprising a ratchet and pawl.

FIG. 9 is a view of the striker and latch housing in FIG. 8 wherein the striker is in a partially seatred position.

FIG. 10 is an end view (in schematic form) of the striker entering the movable female portion of the latch housing, in symmetrical alignment therewith.

FIG. 11 is an end view (in schematic form) of the striker and movable female portion in FIG. 10, in asymmetrica alignment.

FIG. 12, comprising

FIGS. 15 and 16 are views of a striker covered by plastics material and having two sides symmetrically tapered in one direction towards an apex.

FIG. 17 is a side view of a striker covered with moulded plastics material presenting two sides tapered in two directions towards an apex for entering a latch housing.

FIGS. 18 and 19 are top and side views of a flattened wire striker two sides of which are symmetrically tapered in at least one direction towards an apex.

DETAILED DESCRIPTION OF THE PREFERRED EMBODIMENT OF THE INVENTION

Figure 1:
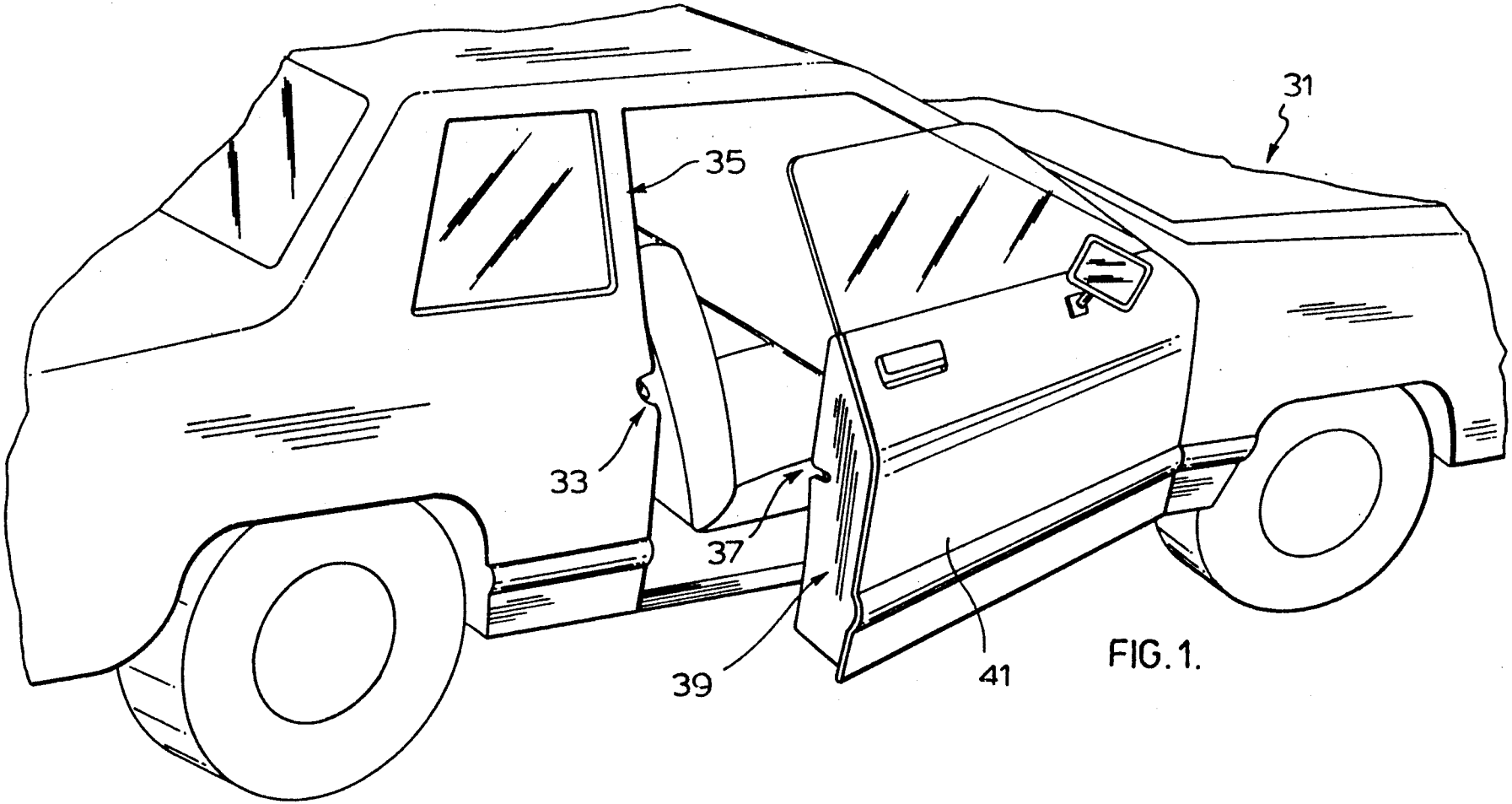
FIG. 1 is a perspective view of a right vehicle door comprising a striker mounted on a pillar and a slot in a door mounted latch housing for receiving the striker.

With reference to FIG. 1 there is shown the right side of a vehicle 31, comprising a symmetrically tapered striker 33 mounted on a pillar 35 and slot 37 in the end face 39 of a door 41. The slot 37 comprises one element of a latch housing 43 (best seen in FIGS. 2 and 3) for receiving the striker 33.

FIGS. 4A and 7A illustrate the striker 71 shown in FIG. 4 and the striker having head 59 shown in FIG. 7 covered in compressible moulded plastics material.

Figure 2:
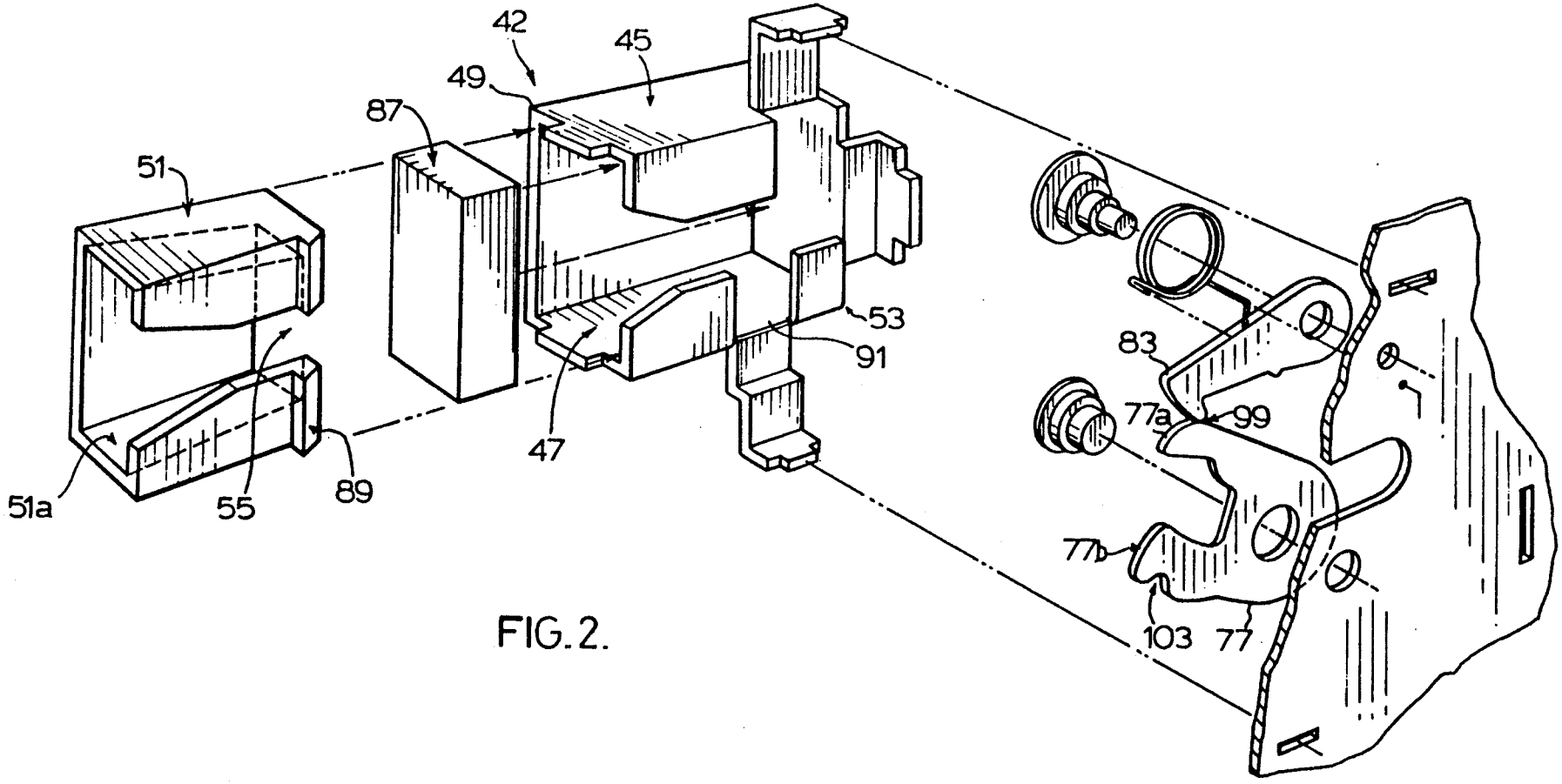
FIG. 2 is an exploded perspective view of a latch housing (for a right door) having a resiliently biased movable female portion, and ratchet and panel mechanism for engaging a striker.
Figure 3:
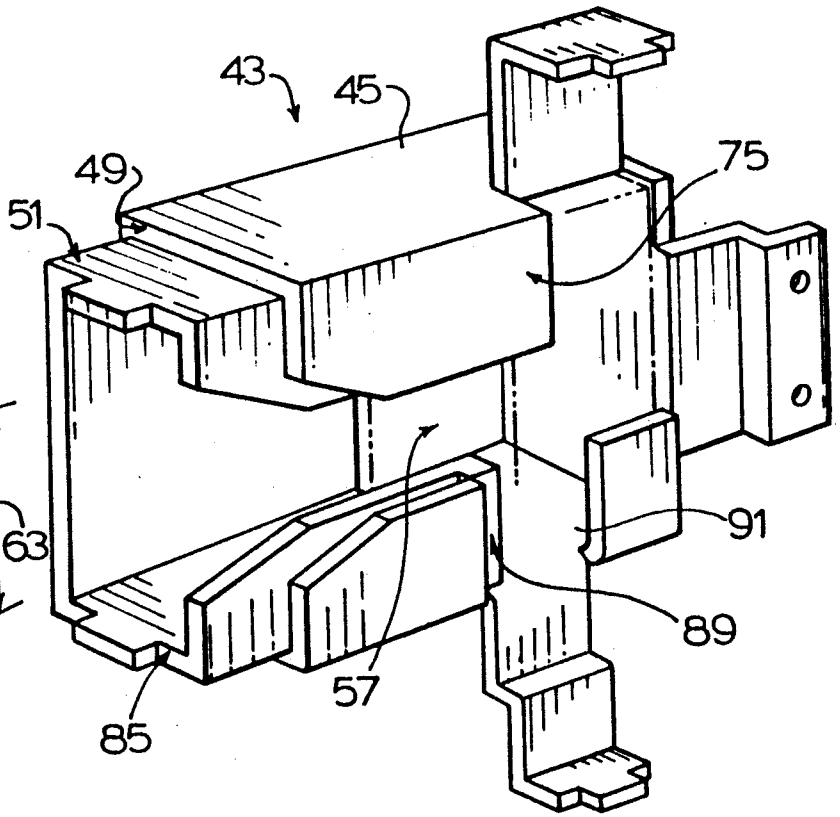
FIG. 3 is a perspective view of the assembled latch housing in FIG. 2 including a view in FIGS. 3*a* of a symmetrically tapered striker for sliding into the latch housing.

Referring to FIGS. 2 and 3 there is shown a latch housing 43 suitable to be mounted to the inside surface of the end face 39 of a right door 41. It will be appreciated that the mirror image of the striker 33 and latch housing 43 shown would be suitable for a left door.

The latch housing 43 has a body 45 of a generally rectangular internal configuration 47. One end 49 of the latch housing body 45 is open for receiving a movable female portion 51. The movable female portion 51 has a generally rectangular external configuration matching the internal configuration 47 of the latch housing body 45, suitable for fitting telescopically inside the body 45. Both the latch housing body 45 and the movable female portion 51 have a slot 53,55 (respectively) extending longitudinally on one side. When the movable female portion 51 is fitted inside the latch housing body 45 (best seen in FIG. 3) the slots 53,55 are aligned parallel and adjacent one 53 to the other 55 to form a single slot 57.

Figure 3A:
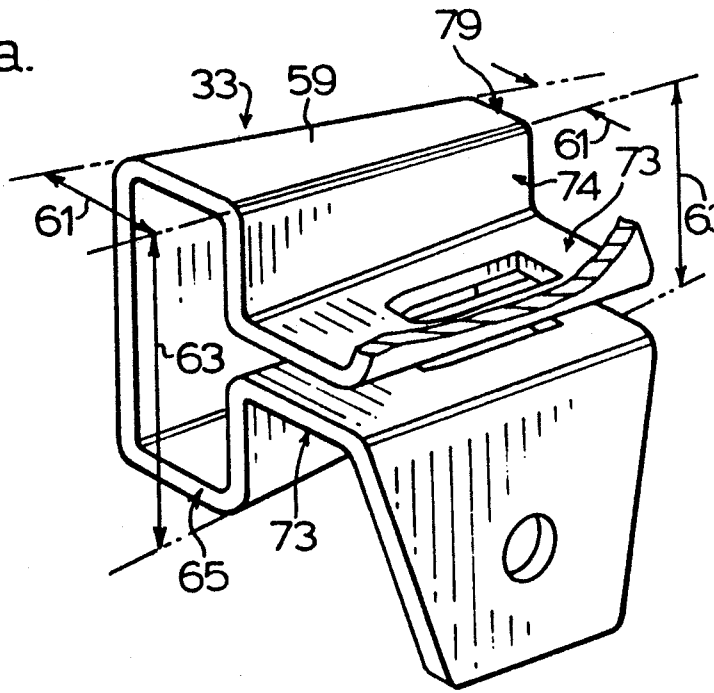

Referring to FIG. 3*a* there is shown a preferred embodiment of the striker 33, having a head 59 which is symmetrically tapered in two directions 61,63, of a generally frustum trapezoidal configuration. All that is necessary is that the height 63 and width 61 of the striker 33 is symmetrically tapered and are greater proximate the base 65 than proximate the apex 67. Referring to FIG. 7 there is shown another embodiment of the striker, having a head 59 which is symmetrically tapered in two directions 61,63 of a generally trapezoidal though not frustum configuration.

The striker shown in FIGS. 3*a* and 7 may be compared to that known in the prior art as depicted in FIG. 5. FIG. 5 depicts a striker 69 having no tapering whatsoever. FIGS. 4 and 6 show a striker 71 tapered in one vertical direction 63 to an apex. The walls 71*a*, 71*b* of the striker 71 oriented in the horizontal axis are parallel one 71*a* to the other 71*b*.

Striker 71 comprises two rectangular portions 71*c* and 71*d* bent at 71*e* and 71*f* intermediate its ends and joined together presenting latch-receiving aperture 200 and mounting apertures 202 and 204. Walls 71*a* and 71*b* have been stamped in a manner to provide two symmetrically laterally extending curved stamped portions tapered towards apex 206 (directed for entering a latch housing). The striker shown in FIG. 7 is similar in construction to the striker in FIG. 4 except that two sides of the striker are symmetrically tapered in another direction as shown towards apex 206.

Referring to FIGS. 2 and 3 the movable female portion 51 has an inside surface 51*a* of a generally frustum trapezoidal configuration matching the configuration of the striker head 59. As appears from FIG. 3*a*, in the particular embodiments shown the striker 33 has a shank 73 extending laterally away from one tapered side 74 of the head 59; the shank 73 for mounting the striker 33 on either of a pillar 35 or a door 41. When the striker 59 is seated in the cavity 51*a* of the movable female portion 51, the shank 73 is slideably received in the slot 57 extending longitudinally on one side 75 of the latch housing 43. In an alternative embodiment (not shown) the shank 73 for mounting the striker 33 may extend laterally away from the base 65 of the striker 33, thereby eliminating the need for the longitudinally extending slot 57. All that is necessary is that the cavity 51*a* of the movable female portion 51 surround the striker head 59 at least about 360° when the striker 59 is seated therein.

With reference to FIGS. 8, 9, 10 and 11, normally when the door 41 is closed the striker 33 slides into the cavity 51*a* of the movable female portion 51. In the embodiment shown the shank 73 advances the ratchet 77 upon contact therewith as the striker head 59 is seated in the cavity 51*a*. It will be appreciated that in the vehicle door locking mechanism tolerance in the fit between the striker 33 and the cavity 51*a* facilitates the engagement of striker 33 with the latch housing 43. As appears from FIGS. 3*a* and 10, symmetrical alignment of the apex 79 portion of the striker head 59 with the cavity 51*a* is possible. Where symmetrical alignment of apex 79 portion of the striker head 59 with the cavity 51*a* is lacking, as depicted in FIGS. 9 and 11, seating engagement of the striker head 59 in the cavity 51*a* is nonetheless possible since tolerance is provided between the symmetrically tapered sides 74 of the striker head 59 proximate its apex 79 and the symmetrically taper walls 81 (as in FIGS. 8, 9, 10 and 11) of the cavity 51*a*. The compatible configuration of the striker head 59 and the cavity 51*a* defined by its walls 81 (in the preferred embodiment shown having a generally frustum trapezoidal configuration) guides the striker head 59 into a fully seated position (best seen in FIGS. 12, 13 and 14).

With references to FIG. 9, even in a partially seated position the shank 73 advances the ratchet 77 sufficiently to engaged one leg 77*a* of the ratchet 77 with the pawl 83 for locking in a secondary position—as for example when the door 41 is lightly closed.

With reference to FIG. 13, in one embodiment normally when the door 41 is ajar the movable female portion 51 proximate its end portion 85 is substantially flush with the end 49 of the latch housing body 45. A compressible rubber block 87 uis provided for, inter alia, maintaining the normal position of the movable female portion 51. Preferably a detent member 89 (only seen in FIGS. 2 and 3) projects into a slot 91 in the latch housing body and is movable within the limits of the slot 91 to limit the extension of the movable female portion 51 out of the latch housing body 45 and to limit the retraction of the movable female portion 51 into the latch housing body 45. When the striker head 59 enters the cavity 51*a* asymmetrically as depicted in FIG. 13*b*, it is guided by the tapered walls 81 into a fully seated position as depicted in FIG. 13*c*. Because the striker 33 is guided by the tapered walls 81 at a predetermine fit is provided and the leading edge 93 of the shank 73 will advance the ratchet 77 a predetermined amount as seating progresses.

Figure 13A:
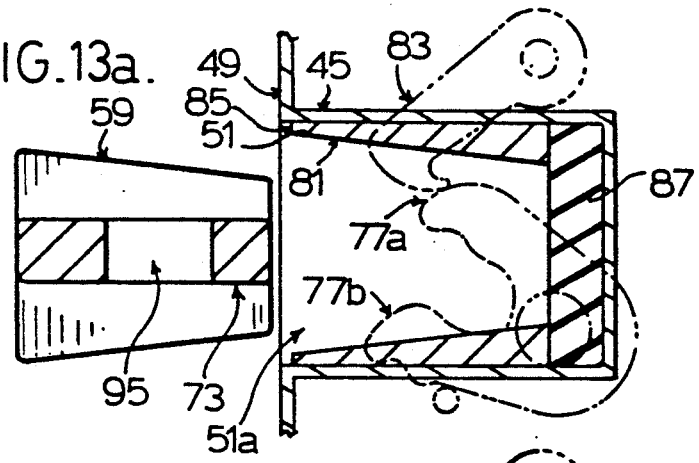
FIG. 13 is a schematic side view of the striker and latch housing in FIGS. 3, 8 and 9; comprising FIGS. 13*a*, 13*b*, 13*c* and 13*d* demonstrating the locking sequence, in one embodiment.
Figure 13B:
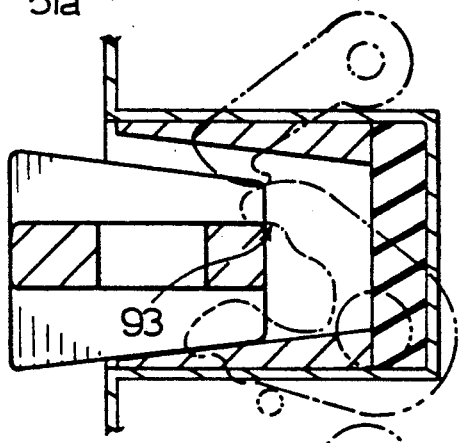
Figure 13C:
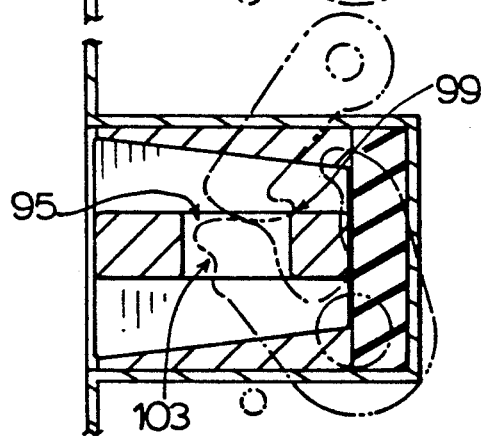
Figure 13D:
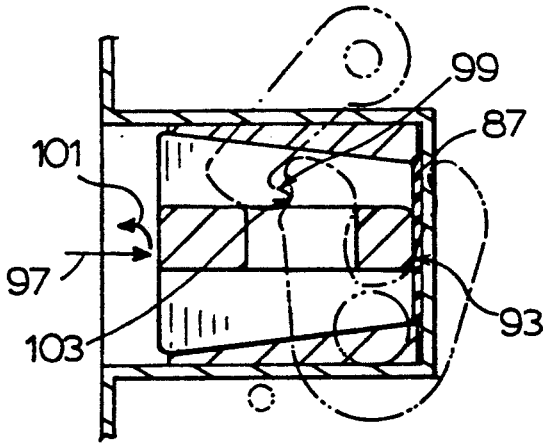

The shank 73 has a hole 95 therethrough for receiving the locking leg 77*b* of the ratchet 77. Referring to FIGS. 13*c* and 13*d*, when the striker head 59 is seated in the cavity 51*a* (as in FIG. 13*c*) the movable female portion 51 will slide linearly into the latch housing body 45, as represented by straight arrow 97. The linear movement 97 ensures complete seating of the striker by allowing for further linear tolerance: simultaneously the rubber block 87 is compressed and the leading edge 93 of the 3 over-rotates the ratchet 77 beyond the primary engagement position wr movemeherein the detent 99 projecting from the pawl 83 securely engages the locking leg 77*b* of the ratchet. The compressed rubber block 87 then expands, thereby causing the movable female portion to recoil, as represented by curved arrow 101, thereby ensures that the detent 99 seats securely in the saddle portion 103 (as in FIGS. 13*c* and 13*d*) of the ratchet locking leg 77*b*.

Figure 12A:
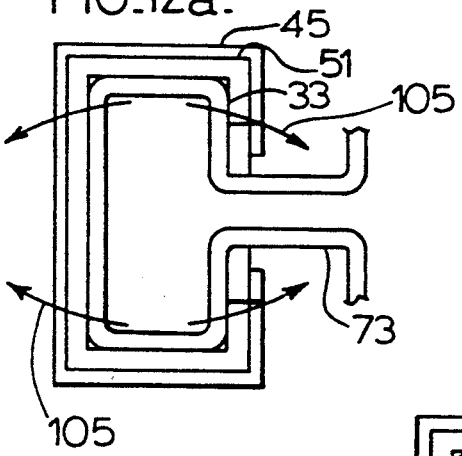
FIGS. 12*a*, 12*b*, and 12*c* is an end view of the striker seated in the latch housing, demonstrating the load bearing qualities of the locking mechanism when the movable female portion surrounds the striker head at least about 360°.
Figure 14A:
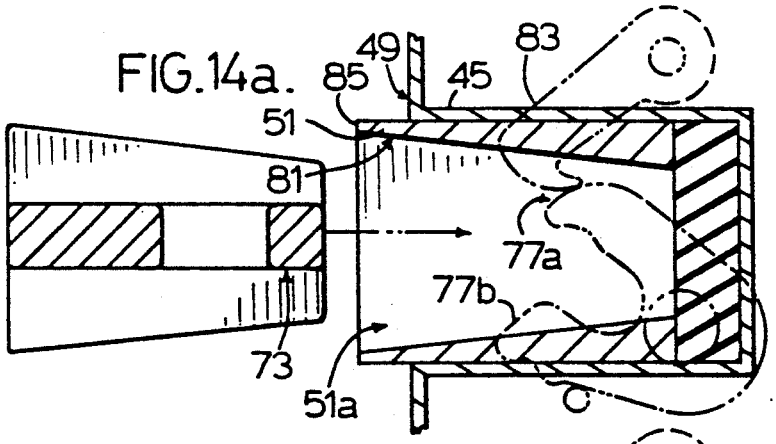
FIG. 14 is a schematic side view of the striker and latch housing in FIGS. 3, 8 and 9; comprising FIGS. 14*a*, 14*b*, 14*c*, 14*d* and 14*e* demonstrating the locking sequence, in an alternative embodiment.
Figure 14B:
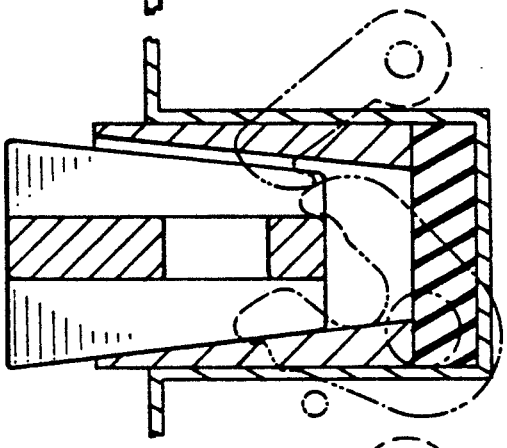
Figure 14C:
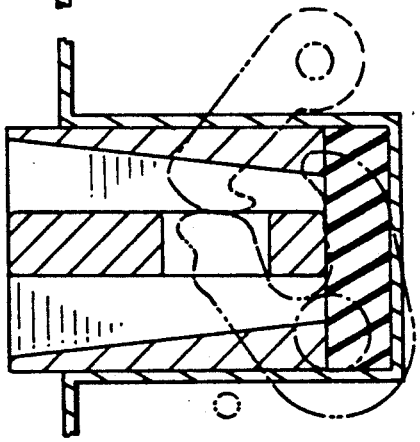
Figure 14D:
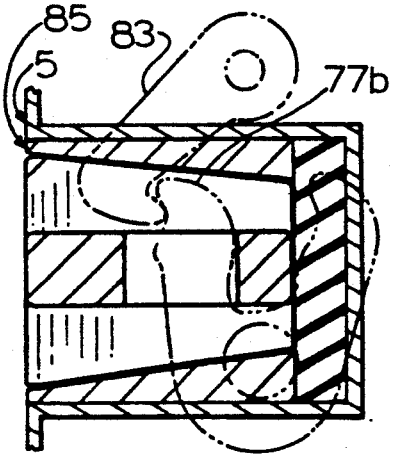
Figure 14E:
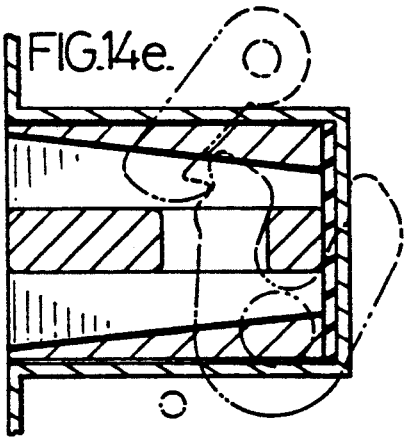

With reference to FIG. 12, once the striker 33 is seated as in FIGS. 13*d* or 14*d* it is surrounded by the latch housing at least about 360° and any load exerted upon the engaged latch (as in the position of FIGS. 13*d* or 14*d*) is evenly distributed—for example to evenly distribute torsional forces as represented by curved arrows 105.

Figure 12B:
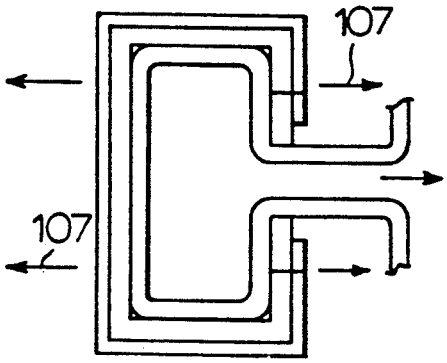
Figure 12C:
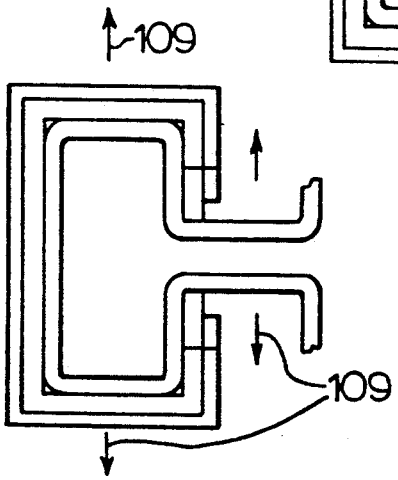

Referring to FIG. 12*b*, the symmetrical lateral tapering 61 (as in FIG. 3*a*) evenly distributes lateral forces as represented by horizontal arrows 107 and urges the end face 39 of the door 41 towards the pillar 35. Referring to FIGS. 12*c*, the symmetrical vertical tapering 63 (as in FIG. 3*a*) evenly distributes vertical forces as represented by vertical arrows 109. It will be appreciated that the latch mechanism disclosed is appropriate for vertically opening doors such as tailgates and accordingly any references to lateral, horizontal or vertical orientation are in the context of the particular embodiment depicted.

With reference to FIG. 14 there is shown a preferred embodiment of the latch mechanism described with reference to FIG. 13. In the preferred embodiment shown, normally when the door 41 is ajar the movable female portion 51 proximate its end portion 85 overextends the end 49 of the latch housing body 45. When the striker head 59 is seated in the cavity 51*a* (as in FIG. 14*c*) the movable female portion 51 will slide linearly into the latch housing body 45 to a position where the movable female portion proximate its end portion 85 is substantially flush with the end 49 of the latch housing body 45 without compressing the rubber block 87 (as depicted in FIG. 14*d*). Advantageously the ratchet 77 is engaged by the pawl 83 in the primary locking position shown in FIG. 14*d*—for example where the door 41 is lightly closed without enough force to compress the rubber block 87. The linear movement of the female portion 51 allows further linear tolerance to ensure seating. Normally, where the door 41 is slammed shut, the movable female portion 51 will compress the rubber block; simultaneously the shank 73 will over-advance the ratchet 77. The recoiling of the movable female portion will ensure that the ratchet detent 99 engages the saddle 103, as is the same with reference to FIG. 13*d*.

With reference to FIGS. 15, 16 and 17, striker 300 comprises a U-shaped rod 301 comprising a pair of legs 302 and 304 anchored to a base 306 and a connector rod 308 connecting the legs 302 and 304. The connector 308 and portions of the upper ends of the legs 302 and 304 connected to the connector 308 being covered by moulded plastics compressible material 310, the covered portion 310 presenting two sides 312 and 314 tapered in a direction towards apex 316 directed to entering a latch housing. The end 318 remote apex 316 is thickened. With respect to FIG. 17, the two sides 314 and 312 taper in another direction 320 and 322 towards an apex directed for entering a latch housing.

With reference to FIGS. 18 and 19, the striker 400 comprises a pair of legs 402 and 404 anchored to base 406 and a flattened connector wire 408 connecting the legs 402 and 404, the flattened connector wire 408 presenting two sides 410 and 412 symmetrically tapered in one direction towards apex 414 directed for entering a latch housing.

With respect to FIG. 19, the flattened connector is shown with the two sides 416 and 418 dotted and symmetrically tapered in an additional direction towards apex 414 directed for entering a latch housing (not shown).

As many changes can be made to the embodiment of the invention without departing from the scope of the invention, it is intended that all material be considered as illustrative of the invention and not in a limiting sense.

The embodiments of the invention in which an exclusive property or privilege is claimed are as follows:

1. A striker comprising a substantially U-shaped rod providing first and second legs anchored to a base and a flattened connector wire connecting the legs, the connector wire and portions of the first and second legs of the U-shaped rod providing a head for the striker, the flattened connector wire presenting at least two sides, between said legs, symmetrically tapering in a direction from proximate said first leg to proximate said second leg towards a latch housing in use.

2. The striker of claim 1, wherein the flattened connector is symmetrically tapered in at least two directions towards a latch housing in use.

3. A striker comprising a substantially U-shaped rod having a pair of legs having two ends, the legs being anchored to a base proximate one end of said legs, the base for mounting the striker in use, the striker having a connector rod connecting the pair of legs remote said base, the connector rod and portions of the end of the legs connected to the connector remote said base providing a head, said head having two ends, length, width and height, and at least one pair of opposed sloping sides, each sloping side being oriented in the length and height of the head tapering towards one another along a substantial length of the head substantially between said legs from a first broad portion positioned at least proximate one end to a second portion narrower than the first broad portion, the second portion being positioned proximate the other end for entering a latch housing.

4. The striker of claim 3, wherein the at least one pair of sloping sides further comprises at least a second pair of sloping sides oriented in the length and width of the head also tapering towards one another along a substantial length of the head substantially between said legs from a third broad portion positioned at least proximate one end to a fourth portion narrower that the third portion, the fourth portion being positioned proximate the other end.

* * * * *